US010343179B2

(12) United States Patent
Ito et al.

(10) Patent No.: US 10,343,179 B2
(45) Date of Patent: Jul. 9, 2019

(54) PAINTING DEVICE

(71) Applicant: HONDA MOTOR CO., LTD., Minato-ku, Tokyo (JP)

(72) Inventors: Yuichi Ito, Tochigi-ken (JP); Shin Ogasawara, Tochigi-ken (JP); Masaaki Shoji, Tochigi-ken (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 15/578,284

(22) PCT Filed: Jun. 2, 2016

(86) PCT No.: PCT/JP2016/066494
§ 371 (c)(1),
(2) Date: Nov. 30, 2017

(87) PCT Pub. No.: WO2016/195044
PCT Pub. Date: Dec. 8, 2016

(65) Prior Publication Data

US 2018/0141061 A1 May 24, 2018

(30) Foreign Application Priority Data

Jun. 3, 2015 (JP) ..... 2015-112988

(51) Int. Cl.
*B05B 3/10* (2006.01)
*B05B 5/04* (2006.01)
(Continued)

(52) U.S. Cl.
CPC ..... *B05B 3/1014* (2013.01); *B05B 1/02* (2013.01); *B05B 1/12* (2013.01); *B05B 3/10* (2013.01);
(Continued)

(58) Field of Classification Search
CPC ..... B05B 3/10; B05B 3/1014; B05B 5/04; B05B 5/0407; B05B 5/0426; B05B 7/1272
See application file for complete search history.

(56) References Cited

U.S. PATENT DOCUMENTS

2009/0078801 A1 3/2009 Takahashi et al.
2010/0021646 A1* 1/2010 Nolte ..... B05B 7/0815 427/421.1
(Continued)

FOREIGN PATENT DOCUMENTS

EP 2058053 5/2009
EP 3056283 A1 * 8/2016 ..... B05B 5/03
(Continued)

OTHER PUBLICATIONS

International Search Report for International Application No. PCT/JP2016/066494 dated Aug. 16, 2016, 6 pages.
(Continued)

*Primary Examiner* — Ryan A Reis
(74) *Attorney, Agent, or Firm* — Amin, Turocy & Watson LLP

(57) ABSTRACT

A painting device is provided with: a bell-shaped cup for discharging paint; a housing for holding the cup so as to be freely rotatable; and first tip openings disposed on the outside in the radial direction on the base end side of the tip side outer peripheral edge of the cup and throwing paint onto a workpiece by spraying shaping air in the direction of the tip. When a tangent line that is tangent to the tip side outer peripheral edge of the cup from a first tip opening is drawn in a front view of the painting device, the first tip opening sprays shaping air at an inclination more to the inside in the radial direction of the cup than the tangent line.

2 Claims, 5 Drawing Sheets

(51) Int. Cl.

| | |
|---|---|
| ***B05B 7/12*** | (2006.01) |
| ***B05B 1/02*** | (2006.01) |
| ***B05B 1/12*** | (2006.01) |
| ***B05B 12/18*** | (2018.01) |

(52) U.S. Cl.
CPC ..... *B05B 5/04* (2013.01); *B05B 5/0426* (2013.01); *B05B 7/1272* (2013.01); *B05B 12/18* (2018.02); *B05B 5/0407* (2013.01)

(56) References Cited

U.S. PATENT DOCUMENTS

| | | | | |
|---|---|---|---|---|
| 2011/0210180 | A1* | 9/2011 | Perinet | B05B 3/1092 239/1 |
| 2013/0040064 | A1* | 2/2013 | Shigekura | B05B 3/02 427/427.3 |

FOREIGN PATENT DOCUMENTS

| | | | | |
|---|---|---|---|---|
| JP | 2600390 | | 4/1997 | |
| JP | 3870794 | B2 * | 1/2007 | B05B 5/0407 |
| JP | 2007-021328 | | 2/2007 | |
| JP | 2009-050820 | | 3/2009 | |
| JP | 2012-040498 | | 3/2012 | |
| JP | 2012040498 | A * | 3/2012 | B05B 3/1092 |
| WO | 2011125855 | | 10/2011 | |

OTHER PUBLICATIONS

Written Opinion for International Application No. PCT/JP2016/066494 dated Aug. 16, 2016, 5 pages.

* cited by examiner

PAINTING DEVICE

TECHNICAL FIELD

The present invention relates to a painting device that applies paint to a workpiece by spraying the paint by jetting out shaping air.

BACKGROUND ART

When a workpiece such as a body of an automobile is painted, a painting device (a rotary atomization painting device) as disclosed in Japanese Patent No. 2600390, for example, is used. By rotating a bell-shaped cup to thereby discharge paint, and jetting shaping air toward the distal-end-side outer peripheral edge of the cup, this painting device atomizes the discharged paint and applies the paint to a workpiece. Moreover, the jet direction of the shaping air of the painting device is directed along a tangent to the outer peripheral edge of the cup when viewed in a front view (see FIG. 2 of Japanese Patent No. 2600390).

SUMMARY OF INVENTION

Incidentally, in this type of painting device, due to the spread of the jetted shaping air, the paint discharged from the cup is easily scattered in the radially outward direction of the painting device, and the application area of the paint on the workpiece tends to be large. As a result, for example, in the case of a workpiece with a narrow application range, the paint is not concentrated in an intended range, which undesirably reduces application efficiency and results in waste of paint.

The present invention has been made to solve the above-described problem, and an object of the present invention is to provide a painting device that can improve the efficiency of application of paint to a workpiece by satisfactorily preventing the spread of the paint caused by shaping air with a simple configuration.

To attain the above-described object, the present invention is a painting device including: a bell-shaped cup configured to discharge paint; a housing configured to rotatably hold the cup; and a jetting port that is provided in the housing and located on a radially outward side and a proximal end side of a distal-end-side outer peripheral edge of the cup, the jetting port being configured to jet out shaping air in a distal-end direction to thereby spray the discharged paint toward a workpiece, wherein, if a circumscribed tangent which is tangent to the distal-end-side outer peripheral edge of the cup is drawn from the jetting port when viewed in a front view of the painting device, the shaping air is jetted out from the jetting port in a direction inclined radially inwardly of the cup with respect to the circumscribed tangent.

In accordance with the above, the painting device can satisfactorily prevent the paint from being spread by the shaping air with a simple configuration including the jetting port from which shaping air is jetted out in a direction inclined radially inwardly of the cup with respect to the circumscribed tangent. That is, by inclining the jet direction of the shaping air toward the inside with respect to the circumscribed tangent, the jetting port can cause the paint flying off by a centrifugal force associated with the rotation of the cup to be sprayed on a small area in the distal-end direction of the painting device, by the shaping air. As a result, the painting device achieves an improvement in the efficiency of application of the paint to a workpiece, and consequently applies the paint to, for example, a workpiece with a narrow application area in a concentrated manner. Therefore, it is possible to achieve a significant reduction in waste of paint.

In this case, when viewed in the front view, in the jetting port, the angle of inclination of the jet direction of the shaping air with respect to an intersection-point tangent that is tangent to the distal-end-side outer peripheral edge at an intersection point of the jet direction of the shaping air and the distal-end-side outer peripheral edge of the cup may be set so as to be smaller than or equal to 30°.

As described above, as a result of the angle of inclination of the jet direction of the shaping air being set so as to be smaller than or equal to 30°, the jetting port can satisfactorily narrow the range of the direction in which the paint actually flies.

Moreover, it is preferable that, within an area from the jetting port to the distal-end-side outer peripheral edge when viewed in a side view of the painting device, the jet direction of the shaping air in the jetting port is set so as to lie outside the distal-end-side outer peripheral edge when viewed in the front view.

As described above, by setting the jet direction of the shaping air so as to lie outside the distal-end-side outer peripheral edge in an area from the jetting port to the distal-end-side outer peripheral edge, the jetting port can make the shaping air sufficiently flow to a distal-end side beyond the distal-end-side outer peripheral edge of the cup. Therefore, the painting device can more satisfactorily narrow the range of the direction in which the paint flies.

Furthermore, it is preferable that the housing includes a regulating jetting port configured to jet out regulating air which regulates a spraying state of the paint, the regulating jetting port being disposed on a radially inward side and a proximal end side of the distal-end-side outer peripheral edge when viewed in the front view.

As described above, by producing a jet of regulating air from the regulating jetting port, the painting device can also spray the paint in such a way as to spread the paint radially outwardly of the cup, and thus it is possible to increase the flexibility of the application range of the paint.

According to the present invention, the painting device can satisfactorily prevent the paint from being spread by the shaping air with a simple configuration and improve the efficiency of application of the paint to a workpiece.

DESCRIPTION OF EMBODIMENTS

Hereinafter, a preferred embodiment of a painting device according to the present invention will be described in detail with reference to the attached drawings.

Figure 1:
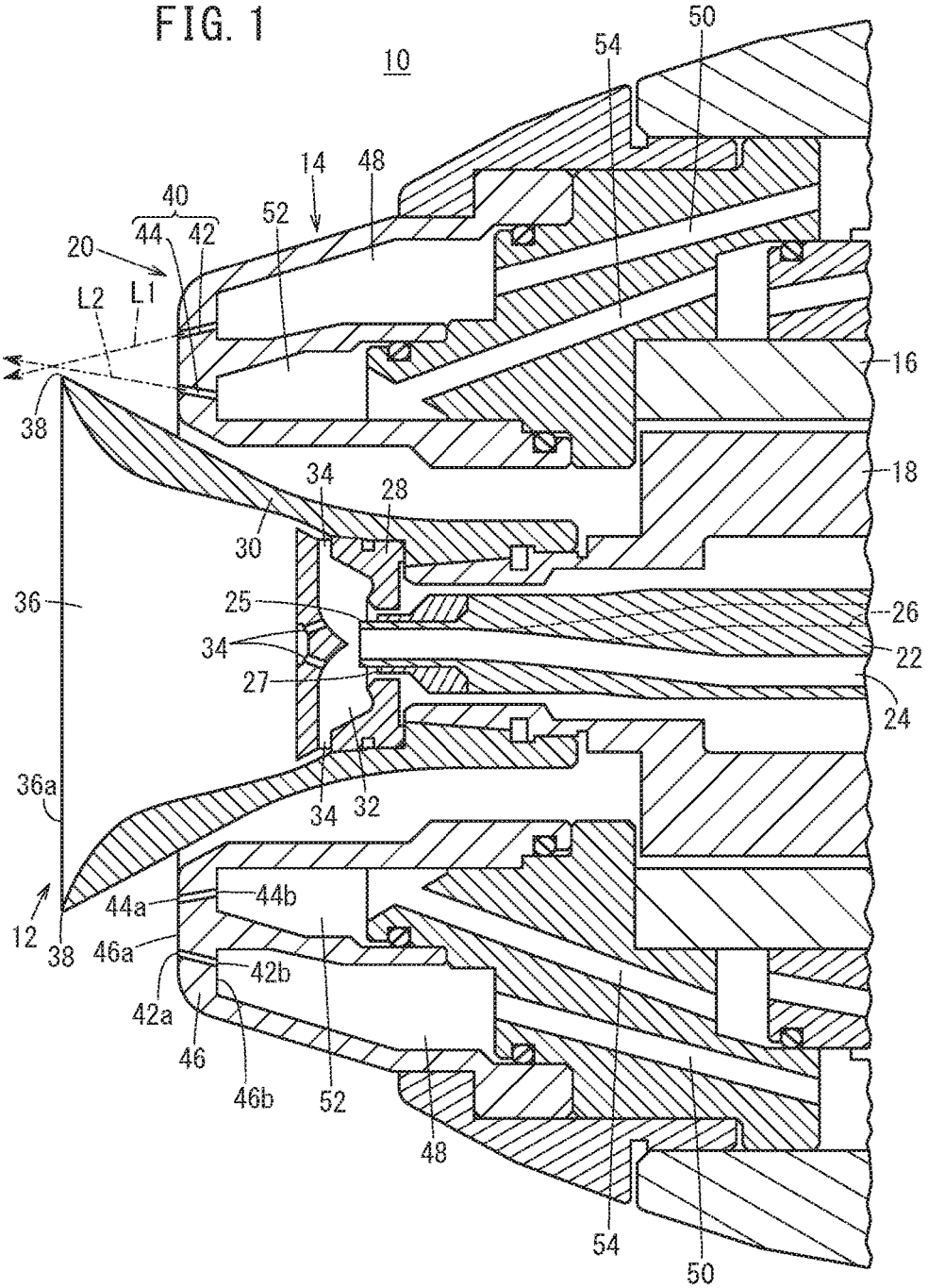
FIG. 1 is a side sectional view depicting a distal end portion of a painting device according to an embodiment of the present invention.

As depicted in FIG. 1, a painting device 10 according to an embodiment of the present invention is configured as a rotary atomization-type device including a bell-shaped cup 12 that discharges paint and a housing 14 that rotatably holds the cup 12. This painting device 10 applies paint to a workpiece (not shown), which is an object to be coated, by causing the paint to fly off radially outwardly by a centrifugal force which is generated at the time of rotation of the cup 12, and spraying the paint in a distal-end direction by shaping air jetted from the housing 14.

Specifically, the painting device 10 includes the above-described housing 14, an air motor 16 provided in the housing 14, a shaft 18 that is rotated by the air motor 16, the above-described cup 12 provided at a distal end of the shaft 18, and an air jetting unit 20 that jets shaping air.

The housing 14 forms a main exterior appearance of the painting device 10 and is formed so as to have a cylindrical shape as a whole. This housing 14 is formed so as to taper in a distal-end direction when viewed in a side sectional view, and an application unit that applies paint is provided on a distal-end side thereof. The application unit forms the air jetting unit 20 as a result of a plurality of structural members being assembled together, and further houses the air motor 16 and the shaft 18 therein.

The air motor 16 is provided so as to surround the radial outside of the shaft 18 and rotates the shaft 18, which is rotatably attached to the housing 14, at high speed by supply of compressed air from an unillustrated compressed air source. The shaft 18 is formed in the shape of a hollow cylinder and extends in the housing 14 in an axial direction, and an unillustrated high-voltage generating device is connected to a proximal end side thereof. A negative high voltage which is supplied from the high-voltage generating device is applied to the cup 12 on the distal-end side through the shaft 18 to thereby electrify the paint, whereby electrostatic painting is performed. In the shaft 18, a tube member 22 is provided.

The tube member 22 is a hollow tube extending in the central axis of the shaft 18 in the axial direction and has inside a paint supply channel 24 and a cleaning liquid supply channel 26. The paint supply channel 24 is connected, at a proximal end side thereof, to an unillustrated paint supply source, and allows the paint supplied from the paint supply source to flow therethrough in the distal-end direction. The cleaning liquid supply channel 26 is connected, at a proximal end side thereof, to an unillustrated cleaning liquid supply source, and allows a cleaning liquid supplied from the cleaning liquid supply source to flow therethrough in the distal-end direction. The paint supply channel 24 and the cleaning liquid supply channel 26 extend in parallel with each other to some midpoint of the tube member 22 in the distal-end direction, and then form a coaxial double-layer structure on the distal-end side of the tube member 22. On the distal-end side of the tube member 22, a paint supply nozzle 25 that discharges the paint is provided, and a cleaning liquid supply nozzle 27 that discharges the cleaning liquid is provided so as to surround the periphery of the paint supply nozzle 25.

The cup 12 that forms the application unit of the painting device 10 is fixed to the distal end of the shaft 18, and, when the shaft 18 is rotated by driving of the air motor 16, the cup 12 rotates integrally with the shaft 18. When viewed in a side sectional view, the cup 12 includes an inner member 28 that surrounds the perimeter of the paint supply nozzle 25 and the cleaning liquid supply nozzle 27 of the shaft 18, and an outer member 30 that houses the inner member 28 and is formed so as to widen (in the shape of a bell) in the distal-end direction.

The inner member 28 is formed into a substantially disc shape, and disposed closer to the proximal end side than a distal-end surface 46*a* of the housing 14 as viewed in a side sectional view. In the inner member 28, a reservoir portion 32 that temporarily stores the paint or the cleaning liquid which is supplied from the paint supply channel 24 or the cleaning liquid supply channel 26 is provided. The reservoir portion 32 is formed as a circular space when viewed in a front sectional view, and, in a wall portion of the inner member 28 forming the reservoir portion 32, a plurality of discharge holes 34 that discharge the paint are provided. These discharge holes 34 are formed in the front surface and the side circumferential surface of the inner member 28 so as to pass therethrough from the reservoir portion 32 and allow the paint supplied to the reservoir portion 32 to flow out.

The outer member 30 is formed so as to spread radially outwardly from the inner member 28 in the distal-end direction, and has inside a hollow portion 36 that allows the paint to flow therethrough. At the distal end of the outer member 30, an opening 36*a* that communicates with the hollow portion 36 and allows the paint to be discharged is formed. A distal-end-side outer peripheral edge 38 of the outer member 30 which surrounds the opening 36*a* is located closer to the distal-end side than the distal-end surface 46*a* of the housing 14.

The inner surface of the outer member 30 forming the hollow portion 36 is formed as a smooth surface that allows the paint to flow radially outwardly when viewed in a side sectional view. Moreover, part of the inner face near the opening 36*a* is a curved face that curves at a steep angle toward the outside of the outer member 30 in the radial direction thereof. As a result, the paint discharged from the discharge holes 34 of the inner member 28 flows on the inner surface by a centrifugal force generated by the rotation of the cup 12, and flies off from the opening 36*a* of the cup 12 in the direction of rotation of the cup 12 and in a radial outward flying-off direction (see FIG. 5A).

Figure 2:
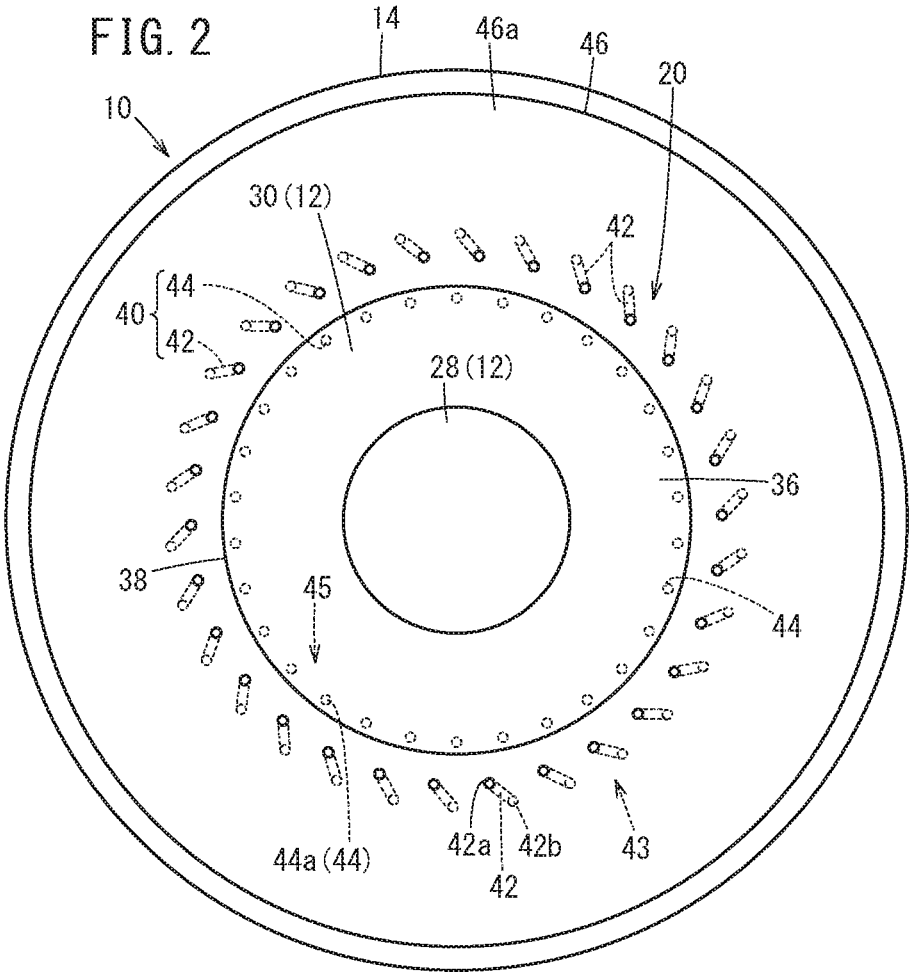
FIG. 2 is a front view depicting the distal end portion of the painting device of FIG. 1.

The air jetting unit 20 of the painting device 10 is provided in the housing 14 surrounding the cup 12. As depicted in FIGS. 1 and 2, the air jetting unit 20 includes, in the distal-end surface 46*a* of the housing 14, a plurality of jet holes 40 through which shaping air is jetted out. The plurality of jet holes 40 form two ring-shaped groups (jet hole groups) in different locations of the housing 14 in the radial direction thereof. Specifically, in a front view shown in FIG. 2, the jet holes 40 include a plurality of first jet holes 42 located radially outwardly of the distal-end-side outer peripheral edge 38 of the outer member 30, and second jet holes 44 located radially inwardly of the distal-end-side outer peripheral edge 38 of the cup 12. The plurality of first jet holes 42 form a first jet hole group 43 by being provided at regular intervals in the circumferential direction of the housing 14, and the plurality of second jet holes 44 form a second jet hole group 45 by being provided at regular intervals in the circumferential direction of the housing 14 inside the first jet hole group 43.

As depicted in FIG. 1, each first jet hole 42 passes through an end wall 46 of the housing 14 and connects a first distal-end opening 42*a* (a jetting port) in the distal-end surface 46*a* of the end wall 46 and a first proximal-end opening 42*b* in the proximal-end surface 46*b* of the end wall 46. Each second jet hole 44 also passes through the end wall 46 of the housing 14 and connects a second distal-end opening 44*a* (a regulating jetting port) in the distal-end surface 46*a* of the end wall 46 and a second proximal-end opening 44*b* in the proximal-end surface 46*b* of the end wall 46. Moreover, the air jetting unit 20 includes, in the housing 14, a first air chamber 48 and a first air supply channel 50 which communicate with the first jet holes 42, and includes, in the housing 14, a second air chamber 52 and a second air supply channel 54 which communicate with the second jet holes 44.

The first air chamber 48 is formed as a ring-shaped space provided in the circumferential direction on the proximal-end surface side of the end wall 46 of the housing 14. This first air chamber 48 temporarily stores air which is supplied from the first air supply channel 50, and makes the air flow into the plurality of first jet holes 42. The second air chamber 52 is formed as a ring-shaped space provided in the circumferential direction of the housing 14 on the proximal-end surface side of the end wall 46 of the housing 14 and inside the first air chamber 48. This second air chamber 52 temporarily stores air which is supplied from the second air supply channel 54, and makes the air flow into the plurality of second jet holes 44.

The first and second air supply channels 50, 54 are connected respectively to unillustrated air supply sources, and allow air, whose supply amount is controlled by each air supply source, to flow into the first and second air chambers 48 and 52, respectively. Here, the air jetting unit 20 has the function of spraying the paint toward the workpiece by the shaping air jetted from the first jet hole group 43 and regulating the application state of the paint by the shaping air jetted from the second jet hole group 45. Hereinafter, to make distinction between shaping airs, the shaping air from the second jet hole group 45 is referred to as regulating air.

That is, at the time of application of the paint, the air jetting unit 20 produces a high-speed jet of a large volume of shaping air ejected from the first distal-end openings 42*a* via the first air chamber 48 and the first jet holes 42 by supplying a large volume of air from the first air supply channel 50. On the other hand, the air jetting unit 20 produces a jet of a proper amount of regulating air from the second distal-end openings 44*a* via the second air chamber 52 and the second jet holes 44 by supplying, to the second air supply channel 54, the air whose supply amount is appropriately set in accordance with necessity such as the necessity to apply the paint while spreading the paint.

Moreover, the painting device 10 according to the present embodiment sets the jet direction of shaping air which is jetted out from the first distal-end openings 42*a*, by means of the first jet holes 42. That is, the first jet holes 42 extending through the end wall 46 are inclined from the radially outer side toward the radially inner side in the distal-end direction when viewed in the side sectional view shown in FIG. 1, whereby the first distal-end openings 42*a* are arranged closer to the inside in the radial direction than the first proximal-end openings 42*b*. As a result, an extension line L1 of the axis of each first jet hole 42, which is the jet direction of the shaping air, is set so as to pass through an area that is located slightly radially outwardly of the distal-end-side outer peripheral edge 38 of the cup 12 (the outer member 30).

Incidentally, in a manner opposite to the first jet holes 42, the second jet holes 44 are slightly inclined in the end wall 46 from the radially inner side toward the radially outer side in the distal-end direction. As a result, an extension line L2 (the jet direction of the shaping air) of the axis of each second jet hole 44 also passes through an area that is located slightly radially outwardly of the distal-end-side outer peripheral edge 38 of the cup 12.

Figure 3:
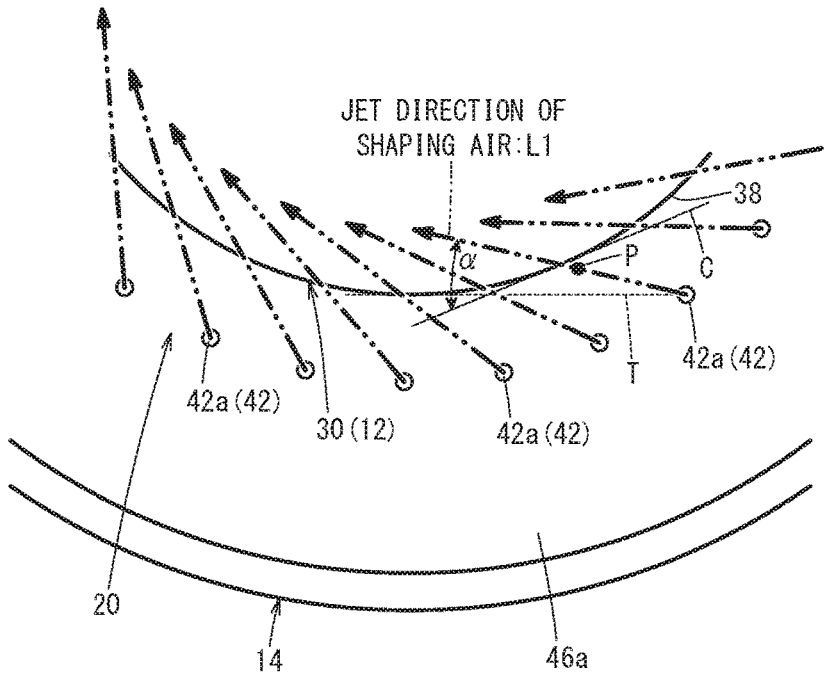
FIG. 3 is an enlarged front view of the distal end portion of the painting device of FIG. 1.

Furthermore, the first jet holes 42 are diagonally inclined in the end wall 46 so that the first distal-end openings 42*a* and the first proximal-end openings 42*b* are out of phase with each other by a few degrees (do not overlap one another in the radial direction) in the circumferential direction when viewed in the front views shown in FIGS. 2 and 3. The circumferential direction in which the first distal-end openings 42*a* are circumferentially shifted from the first proximal-end openings 42*b* is a clockwise direction opposite to a counterclockwise direction which is the direction of rotation of the cup 12. As a result, the first jet holes 42 ejects shaping air from the first distal-end openings 42*a* against the flow of the paint that flies off by the centrifugal force of the cup 12.

As depicted in FIG. 3, the jet direction of the shaping air which is set by each first jet hole 42 is inclined toward the inside with respect to a circumscribed tangent T which is virtually drawn from the first distal-end opening 42*a* so as to circumscribe (be tangent to) the distal-end-side outer peripheral edge 38 of the cup 12. Moreover, the angle of inclination $\alpha$ of the jet direction of the shaping air with respect to an intersection-point tangent C which is tangent to the distal-end-side outer peripheral edge 38 at an intersection point between the jet direction (the extension line L1) of the shaping air and the distal-end-side outer peripheral edge 38 is preferably set within a range of $0° < \alpha \leq 30°$. If the angle of inclination $\alpha$ is smaller than or equal to 0°, as described above, the shaping air spreads greatly at the distal-end side of the cup 12, which results in a reduction in the efficiency of application of the paint to the workpiece. On the other hand, if the angle of inclination $\alpha$ is greater than 30°, resistance (vector) against a flying-out force of the paint flying in the centrifugal direction is reduced, which also results in the spread of the direction in which the paint actually flies. In the first jet hole group 43, the angles of inclination $\alpha$ of the jet directions by the first jet holes 42 are set to be the same, and the first distal-end openings 42*a* each produce a jet of shaping air in a state of equally inclining the shaping air.

Figure 4:
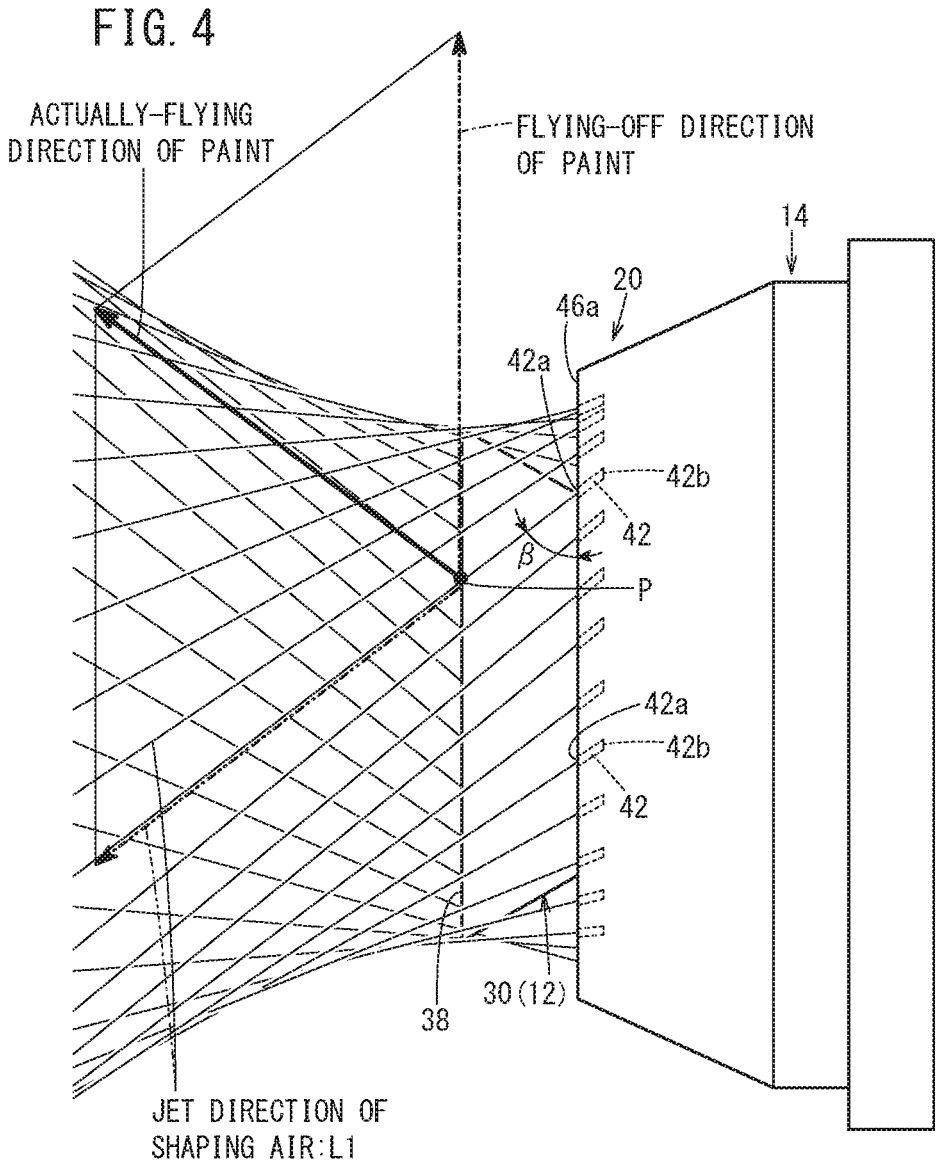
FIG. 4 is a side view depicting a state of shaping air which is discharged by the painting device of FIG. 1.

Furthermore, when viewed in a side view shown in FIG. 4, each first jet hole 42 has a jet direction which is inclined in the circumferential direction of the housing 14. That is, by being inclined at an angle of inclination $\beta$ with respect to the axial direction of the housing 14, the first jet hole 42 jets shaping air diagonally from the first distal-end opening 42*a*. In other words, the first jet hole 42 ejects shaping air in the distal-end direction and in a twisting direction.

The angle of inclination $\beta$ of the jet direction with respect to the axial direction of the housing 14 is preferably set within a range of $30° \leq \beta \leq 70°$, for example. If the angle of inclination $\beta$ is set in this way, even when shaping air is jetted out so as to be inclined toward the inside with respect to the circumscribed tangent T as viewed in a front view, the jet direction of the shaping air in the first jet hole 42 can be set so as to pass through an area that is located radially outwardly of the distal-end-side outer peripheral edge 38, at a position P at which the jet direction and the distal-end-side outer peripheral edge 38 of the cup 12 overlap each other as viewed in a side view. This makes it possible for the first jet hole 42 to produce a jet of shaping air in such a way that the shaping air enters the inside of the distal-end-side outer peripheral edge 38 of the cup 12 after passing a position near the distal-end-side outer peripheral edge 38 of the cup 12. Alternatively, the first distal-end opening 42*a* may produce a jet of shaping air in a jet direction such that the shaping air enters the inside of the distal-end-side outer peripheral edge 38 as viewed in a front view before passing the distal-end-side outer peripheral edge 38. In this case, although the force of flow of the shaping air on the distal-end side of the cup 12 is reduced, since part of the shaping air flows without interfering with the cup 12, it is possible to spray the paint on an inwardly-narrowed area in a manner similar to that described above.

The painting device 10 according to the present embodiment is basically configured as described above, and the operation and effect thereof will be described below.

When performing painting of a workpiece, the painting device 10 applies a high voltage to the shaft 18 and rotates the shaft 18 at high speed by supplying compressed air to the air motor 16, whereby the cup 12 is rotated in a counterclockwise direction as viewed in the front view shown in FIG. 2. Moreover, the painting device 10 supplies paint to the reservoir portion 32 of the cup 12 from the paint supply nozzle 25. The paint supplied to the reservoir portion 32 is discharged from the discharge holes 34 of the inner member 28 to the hollow portion 36 and the inner surface of the outer member 30 by the supply pressure and the rotation of the cup 12.

After being discharged from the discharge holes 34, the paint flies in the distal-end direction by the negative pressure of the jet of shaping air therearound, and also flows on the inner surface of the outer member 30 toward the outside in the radial direction (the centrifugal direction). Then, as indicated by a vector shown by a dot and dash line of FIG. 5A, the paint that has flowed on the inner face of the outer member 30 flies off from the distal-end-side outer peripheral edge 38 in the direction of counterclockwise rotation of the cup 12 and in a radial outward flying-off direction.

On the one hand, the air jetting unit 20 of the painting device 10 supplies air from the air supply source and jets out shaping air from the first distal-end openings 42*a* of the first jet holes 42 via the first air supply channel 50 and the first air chamber 48. As described above, each first distal-end opening 42*a* jets shaping air toward the inside with respect to the circumscribed tangent T which extends from the first distal-end opening 42*a* so as to be tangent to the distal-end-side outer peripheral edge 38 of the cup 12 as viewed in a front view (see FIG. 3). That is, as indicated by a vector shown by a two-dot chain line of FIG. 5A, the jet direction of the shaping air is inclined toward the inside with respect to the intersection point tangent C by the angle of inclination $\alpha$ (>0°). As a result, shaping air is jetted out from the first distal-end opening 42*a* in the distal-end direction so as to twist in the circumferential direction while getting closer to the cup 12 (see also FIGS. 3 and 4). At this time, since the shaping air passes outside the distal-end-side outer peripheral edge 38 of the cup 12 until reaching the position P depicted in FIG. 4, the shaping air is prevented from being blocked by the cup 12.

Figure 5A:
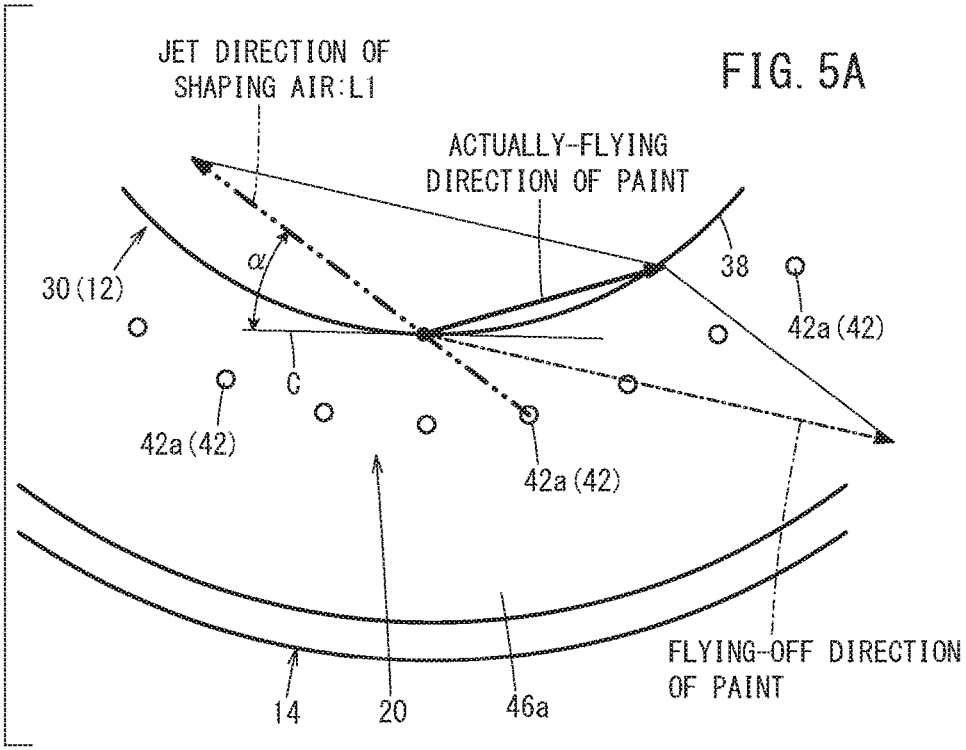
FIG. 5A is an enlarged front view depicting a direction in which paint flies in the painting device of FIG. 1
Figure 5B:
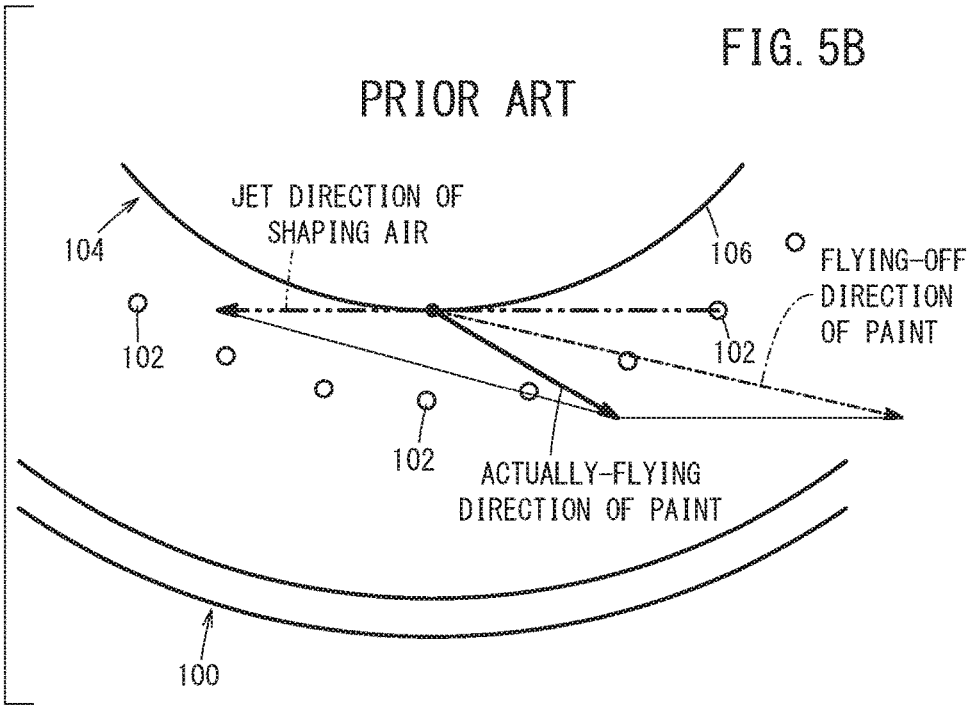
FIG. 5B is an enlarged front view depicting a direction in which paint flies in a conventional painting device.

On the other hand, a conventional painting device 100 has a configuration (the angle of inclination $\alpha$=0°) in which the jet direction of shaping air coincides with a circumscribed tangent T which extends from a jetting port 102 so as to circumscribe (be tangent to) a distal-end-side outer peripheral edge 106 of a cup 104, as indicated by a vector shown by a tow-dot chain line depicted in FIG. 5B, at best. Here, when an intersection point of a vector of the shaping air and the distal-end-side outer peripheral edge 106 is used as a base point, the paint subjected to a centrifugal force generated by rotation of the cup 104 flies off from the distal-end-side outer peripheral edge 106 at a flying-out force indicated by a vector shown by a dot and dash line. Meanwhile, the shaping air acts on the paint and blows away the paint as indicated by the vector shown by the two-dot chain line. As a result, the direction in which the paint actually flies (or is actually sprayed) becomes a direction in which the paint significantly deviates from the flying-off direction toward the outside of the painting device 100, (see a vector shown by a thick line). That is, in the conventional painting device 100, the paint flying off from the distal-end-side outer peripheral edge 106 is spread outwardly by the shaping air, and waste of the paint consequently occurs when coating a small area with the paint.

In contrast, by producing a jet of shaping air in the manner described above, the painting device 10 can cause the paint flying off from the distal-end-side outer peripheral edge 38 of the outer member 30 in the centrifugal direction to get closer to the inside. That is, as depicted in FIG. 5A, when an intersection point of a vector of the shaping air and the distal-end-side outer peripheral edge 38 of the cup 12 is used as a base point, the shaping air acts on the paint flying off at the same flying-out force as that of FIG. 5B and gives an opposing force thereto so that the paint gets closer to the inside in the radial direction as indicated by the vector shown by the two-dot chain line. As a result, the painting device 10 can set the direction in which the paint actually flies to a direction in which the paint gets closer to the radially inside of the housing 14 (see a vector shown by a thick line), and therefore the paint can be efficiently applied on a small area.

Moreover, for coating a wider area with the paint, in the painting device 10, regulating air is jetted out from the second distal-end openings 44*a* of the second jet holes 44 in the distal-end direction and in the radially outward direction. As a result, a vector is added to the vector of the shaping air ejected from each of the first distal-end openings 42*a* so that the direction of the vector of the shaping air is shifted radially outwardly. Thus, it is possible to apply the paint to the workpiece while satisfactorily spreading the paint radially outwardly of the cup 12.

As described above, since the painting device 10 according to the present embodiment has the first distal-end openings 42*a* from which shaping air is jetted out in a direction inclined radially inwardly with respect to the circumscribed tangent T, it is possible to satisfactorily prevent the paint from being scattered by the shaping air. That is, with a simple configuration in which the jet direction of the shaping air is inclined toward the inside with respect to the circumscribed tangent T, a jet of shaping air which is jetted out from the first distal-end openings 42*a* can blow off the paint, which is discharged by the centrifugal force associated with the rotation of the cup 12, in the distal-end direction while preventing the paint from being spread over a wide area. As a result, the painting device 10 can achieve an improvement in the efficiency of application of the paint and apply the paint to, for example, a workpiece with a narrow application range in a concentrated manner.

In this case, as a result of the angle of inclination $\alpha$ of the jet direction of the shaping air being set so as to be smaller than or equal to 30°, the painting device 10 can further lessen the range of the direction in which the paint actually flies. Moreover, by setting the jet direction of the shaping air so as to lie outside the distal-end-side outer peripheral edge 38 within an area to the distal-end-side outer peripheral edge 38 when viewed in a side view, the first distal-end openings 42*a* can make the shaping air sufficiently flow to a distal-end side beyond the distal-end-side outer peripheral edge 38 of the cup 12. Therefore, the painting device 10 can lessen the range of the direction in which the paint flies more satisfactorily. Furthermore, by jetting out regulating air from the second distal-end openings 44*a*, the painting device 10 can also spray the paint in such a way as to spread the paint radially outwardly of the cup 12, and thus it is possible to increase the flexibility of the application range of the paint.

In the above description, the preferred embodiment of the present invention has been described, but it goes without saying that the present invention is not limited to the above-described embodiment and various changes and modifications are possible within the scope of the present invention. For example, the painting device 10 sets the jet direction of the shaping air based on the shape of the first jet hole 42, but the invention is not limited thereto; the jet direction of the shaping air from a jetting port may be set in various ways. Examples include a configuration in which a ring-shaped jetting port is formed in the circumferential direction of the housing 14 and the shaping air is made to flow in a spiral fashion in the housing 14, whereby the flow of the shaping air regulated so as to be inclined in the distal-end direction and in the radially inward direction of the cup 12 is jetted out from the jetting port.

What is claim is:

1. A painting device comprising:

a bell-shaped cup configured to discharge paint;

a housing configured to rotatably hold the cup; and a plurality of jetting ports that are provided in the housing and located on a radially outward side and a proximal end side of a distal-end-side outer peripheral edge of the cup, the plurality of jetting ports being configured to jet out shaping air in a distal-end direction to thereby spray the discharged paint toward a workpiece, wherein the housing includes a plurality of regulating jetting ports configured to jet out regulating air which regulates a spraying state of the paint, the regulating jetting ports being disposed on a radially inward side and a proximal end side of the distal-end-side outer peripheral edge when viewed in a front view, the plurality of jetting ports are arranged mutually independently on a radially outward side of the distal-end-side outer peripheral edge along its circumferential direction, and the plurality of regulating jetting ports are arranged mutually independently on the radially inward side of the distal-end-side outer peripheral edge along its circumferential direction, and the regulating air is jetted out from the plurality of regulating jetting ports in a direction inclined radially outwardly of the cup, and if a circumscribed tangent which is tangent to the distal-end-side outer peripheral edge of the cup is drawn from the plurality of jetting ports as viewed in the front view, the shaping air is jetted out from the plurality of jetting ports in a direction inclined radially inwardly of the cup with respect to the circumscribed tangent at an acute angle of inclination set to be smaller than or equal to 30° with respect to an intersection-point tangent that is tangent to the distal-end-side outer peripheral edge at an intersection point of the jet direction of the shaping air and the distal-end-side outer peripheral edge of the cup.

2. The painting device according to claim 1, wherein, within an area from the plurality of jetting ports to the distal-end-side outer peripheral edge when viewed in a side view of the painting device, a jet direction of the shaping air in the plurality of jetting ports is set so as to lie outside the distal-end-side outer peripheral edge when viewed in the front view.

* * * * *